US006910227B2

(12) United States Patent
Lee

(10) Patent No.: US 6,910,227 B2
(45) Date of Patent: Jun. 28, 2005

(54) SHOCK ABSORBER FOR SHOULDER STRAP

(76) Inventor: Jung Kyun Lee, Dadong 407, Youngwoon Apt., #1003-22 Hwagok-5-Dong, Gangseo-Ku, Seoul 157-015 (KR)

( * ) Notice: Subject to any disclaimer, the term of this patent is extended or adjusted under 35 U.S.C. 154(b) by 0 days.

(21) Appl. No.: 10/802,525

(22) Filed: Mar. 17, 2004

(65) Prior Publication Data

US 2004/0221373 A1 Nov. 11, 2004

Related U.S. Application Data

(63) Continuation-in-part of application No. 10/169,812, filed as application No. PCT/KR00/00122 on Feb. 16, 2000, now abandoned.

(51) Int. Cl.[7] ..... A41D 27/26
(52) U.S. Cl. ..... 2/268
(58) Field of Search ..... 2/268, 69, 79, 2/93, 94, 81, 108, 237, 229, 44, 102, 267, 459, 460–461; 182/3–6

(56) References Cited

U.S. PATENT DOCUMENTS 900,610 A * 10/1908 Stow ..... 224/264
1,546,067 A * 7/1925 Goldschmidt ..... 224/264
4,125,904 A 11/1978 Levine
4,506,868 A 3/1985 Shiroyama et al.
6,223,959 B1 * 5/2001 Chen ..... 224/264

FOREIGN PATENT DOCUMENTS

| | | |
|---|---|---|
| EP | 501623 | 9/1992 |
| KR | U-88-4013 | 5/1988 |

* cited by examiner

*Primary Examiner*—Tejash Patel
(74) *Attorney, Agent, or Firm*—Anderson Kill & Olick, PC

(57) ABSTRACT

A shock absorber for a shoulder strap is provided. The shock absorber includes a panel-like absorbing portion having a plurality of protrusions filled with air and hermetically and separately sealed, and a reinforcement portion sewed together with the absorbing portion and connected to the middle of the shoulder strap having a predetermined width. Accordingly, the weight of the load due to the bag or carried item is alleviated, thereby softening the pain on the shoulder. Therefore, while carrying the bag or item, the user may not be fatigued and feels comfortable.

1 Claim, 6 Drawing Sheets

SHOCK ABSORBER FOR SHOULDER STRAP

The present invention is a continuation-in-part (CIP) of U.S. patent application Ser. No. 10/169,812, filed Jul. 8, 2002, now abandoned, which is a 371 of PCT/KR00/00122, filed Feb. 16, 2000, which is herein incorporated by reference.

BACKGROUND OF THE INVENTION

1. Field of the Invention

The present invention relates to an incorporated or detachably attached shock absorber for a shoulder strap of a bag or item, adapted to alleviate the pain applied on the shoulder or reduce the load applied across the body when one moves with a bag or item carried on one's shoulder. In particular, the present invention relates to a shock absorber for a shoulder strap, which can comfort a user when the user carries a heavy item, by providing a plurality of protrusions filled with air and a reinforcement portion made of resilient material having extensibility, thereby alleviating the pain on the shoulder and reducing the load such that the load of the bag or carried item applied on the shoulder is absorbed in the middle of the protrusions and the reinforcement portion by the action/reaction therebetween.

2. Description of the Related Art

In general, known shoulder straps have been made of webbing or bag materials. Alternatively, the known shoulder straps have been made by inserting conventional shoulder pad or foam made of polyvinyl chloride (PVC) into webbing or bag materials, sewing and adhering the same by a known method.

However, since such shoulder straps lack elongation and have no means for absorbing shock due to the load, the load stress applied in the case when one carries heavy loads on one's shoulder for a long time is directly transmitted to one's shoulder. Thus, one may feel painful and may be extremely fatigued.

In conclusion, since conventional shoulder straps, which lack elongation and have no means for absorbing load shock, the user must bear severe pain on the shoulder due to the weight of the heavy load and extreme fatigue caused thereby.

SUMMARY OF THE INVENTION

To solve the above-described problems, the present invention provides a plurality of protrusions filled with air, creating an absorbing portion formed of air layers, thereby absorbing the shock on one's shoulder, and a reinforcement portion made of a resilient material having extensibility, thereby reducing the load across one's body by action/reaction of the reinforcement portion while carrying a bag or item. Therefore, it is an object of the present invention to provide a shock absorber for a shoulder strap, which can noticeably reduce the load stress actually applied when a user carries a heavy bag or item on the shoulder and can comfort the user by alleviating the pain on the shoulder and consequent fatigue.

To accomplish the above object of the present invention, there is provided a shock absorber for a shoulder strap comprising a panel-like absorbing portion having a plurality of protrusions filled with air and hermetically and separately sealed, the absorbing portion comprising a lower portion, an upper portion forming the protrusions and attached to the lower portion, a protection fiber attached outward to the lower portion, and a protection fiber integrally attached outward to the upper portion conforming to the shape of the protrusions, wherein the plurality of protrusions of the absorbing portion are formed separately by compression-molding thermal polyurethane resin and are arranged in a lattice pattern and a reinforcement portion sewed together with the absorbing portion and connected to the middle of the shoulder strap having a predetermined width and opposite end portions, wherein the reinforcement portion is made of resilient and extensible material, and the length of the reinforcement portion is larger than that of the absorbing portion so that the opposite end portions of the reinforcement portion is can be extended.

According to another aspect of the present invention, there is provided a shock absorber for a shoulder strap including a panel-like absorbing portion having a plurality of protrusions (or air cells) filled with air and hermetically sealed, and a connecting portion sewed together with the absorbing portion and capable of detachably wrapping a predetermined portion of the shoulder strap.

In this embodiment, the reinforcement portion made of a resilient material having extensibility may be separately connected to an arbitrary position of the shoulder strap having a predetermined width.

The feature of the shock absorber for a shoulder strap according to the present invention lies in that it can be employed to both a carried item itself and a bag containing the item such as a bag adapted to be supported by one-side shoulder of a user, or a sack, enabling every item to be carried on one's shoulder with ease and comfort.

Further, according to the shock absorber for a shoulder strap of the present invention, the outer surface of the protrusion may be coated with protection fiber.

In addition, according to the present invention, high-quality products can be attained by forming rubber dots or bio-ceramic dots on the plurality of protrusions formed in the absorbing portion for the purpose of preventing slippage or facilitating blood circulation of the user.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Preferred embodiment of the present invention will now be described in detail with reference to the accompanying drawings.

Figure 1:
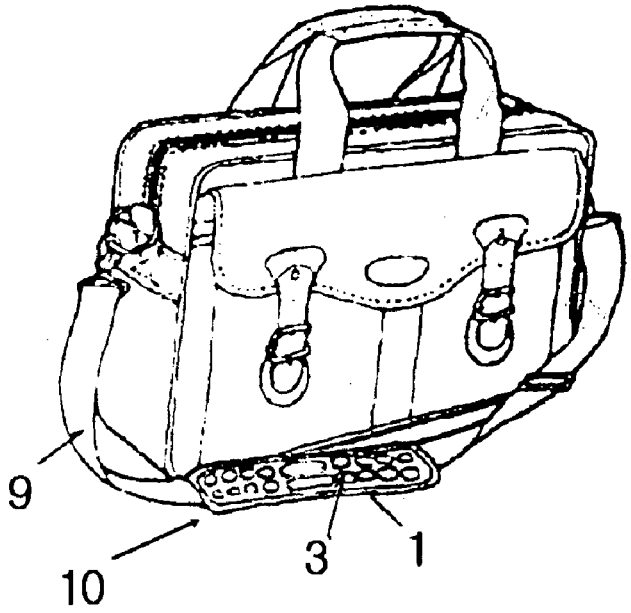
FIGS. 1 and 2 are perspective views schematically illustrating bags each having a shock absorber for a shoulder strap according to the present invention.
Figure 2:
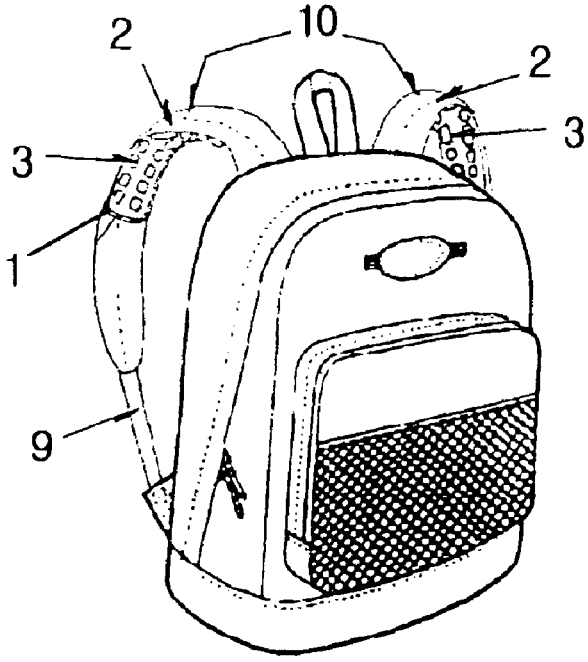

As shown in FIGS. 1 and 2 schematically illustrating bags each having a shock absorber for a shoulder strap according to the present invention, a shock absorber 10 according to this embodiment can be employed to a shoulder strap 9 of a bag to be carried on shoulder of a user. If it is possible to attach a shoulder strap to a carried item itself, the shoulder strap 9 can be employed directly to the carried items. Thus, every item carried on the shoulder of the user can be carried with ease and comfort.

Figure 3:
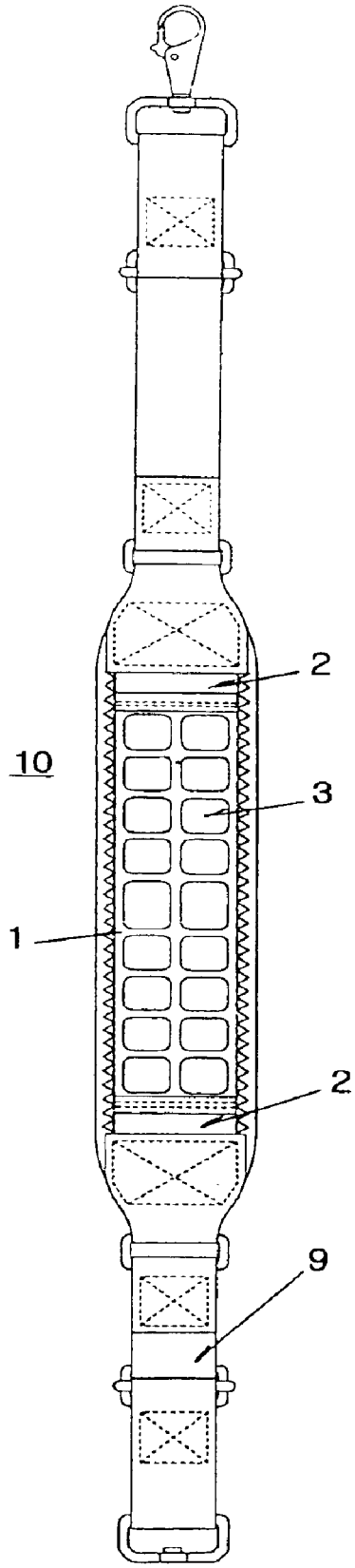
FIG. 3 is a plan view of a shock absorber for a shoulder strap according an embodiment of the present invention.
Figure 4:
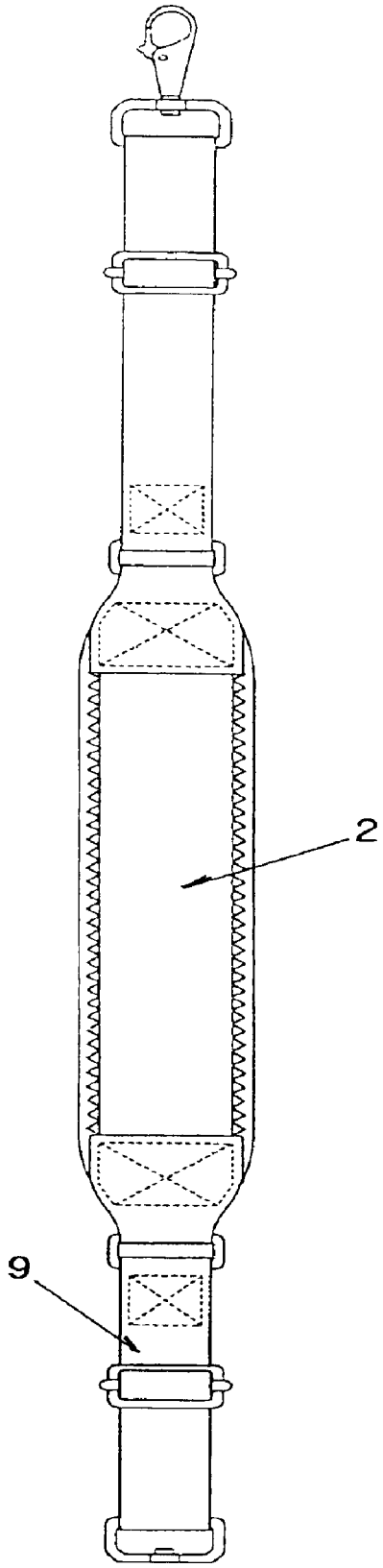
FIG. 4 is a rear view of the shock absorber for a shoulder strap shown in FIG. 3.
Figure 5:
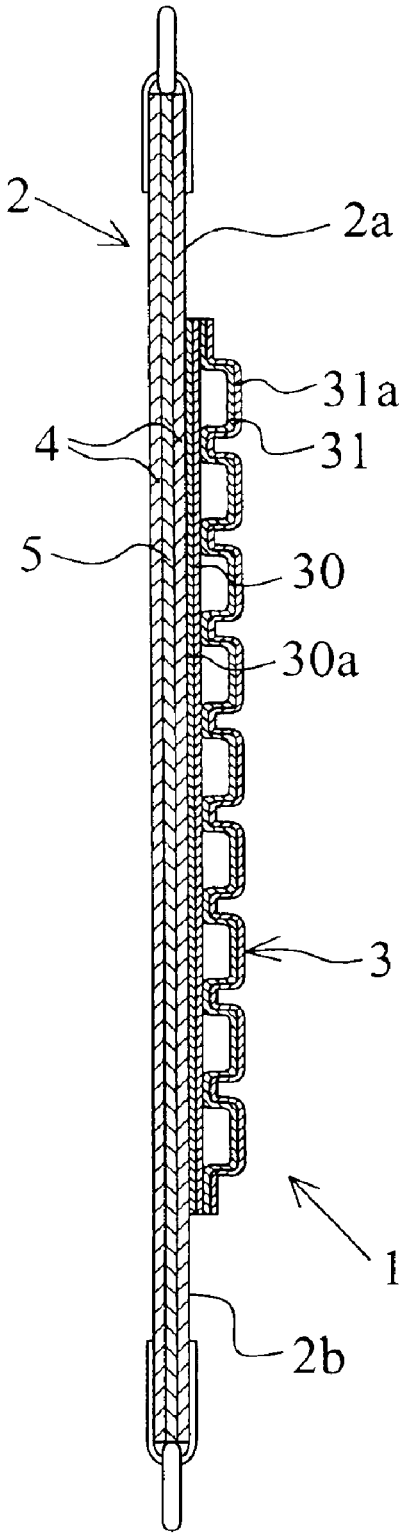
FIG. 5 is a longitudinal sectional view of the shock absorber for a shoulder strap shown in FIG. 3.

The shock absorber 10 for a shoulder strap according to the present invention will now be described in more detail with reference to FIGS. 3 through 5. FIG. 3 is a plan view of a shock absorber for a shoulder strap according an embodiment of the present invention, FIG. 4 is a rear view of the shock absorber for a shoulder strap shown in FIG. 3, and FIG. 5 is a longitudinal sectional view of the shock absorber for a shoulder strap shown in FIG. 3. As shown in the drawings, the shock absorber 10 includes a panel-like absorbing portion 1 having a plurality of protrusions 3 filled with air and hermetically and separately sealed, and a reinforcement portion 2 which is formed of an resilient material having extensibility, is sewed with the absorbing portion 1 and is connected to the middle of the shoulder strap 9 having a predetermined width.

The absorbing portion 1 includes the plurality of protrusions (or air cells) 3 arranged in a lattice pattern, as shown in FIG. 3, and the shape and pattern of the protrusions are not limited thereto. The protrusions 3 are formed separately by compression-molding thermal polyurethane (TPU) resin that is highly resilient and transparent. Also, since the internal portions of the protrusions 3 are filled with air to serve as an air cushion, the absorbing portion 1 can maximize the effect of absorbing the shock applied in a user's shoulder due to the load of the carried item.

The upper and lower portions 30, 31 of the absorbing portion 1 are integrally coated with natural or synthetic protection fibers 30*a*, 31*a* respectively for protecting the surfaces of the absorbing portion 1.

The reinforcement portion 2 is made of resilient and extensible material including spandex or neoprene layers 4 and rubber band 5, and the length of the reinforcement portion 2 is larger than that of the absorbing portion 1 so that the opposite end portions 2*a*, 2*b* of the reinforcement portion 2 can be extended. As shown in FIGS. 3 and 4, the reinforcement portion 2 is sewed lengthwise along its both sides together with the absorbing portion 1 to be connected to the middle of the shoulder strap 9. Thus, an impact force due to the weight of the load of the bag or item can be reduced by cushion of the absorbing portion and the resilience of the reinforcement 2 while moving with the bag or item carried on one's shoulder.

The protection fiber 31*a* integrally coated on the upper portion 31 of the absorbing portion 1 provides the air cells or protrusions 3 with durable airtightness in addition to protection against puncture or abrasion. The protection fiber 31*a* limits deformation or over-expansion of the air cells under compression so that it can prevent the weakness of the upper portion and thus can prevent air leakage of the air cells. The absorbing portion according to the present invention can provide with ventilation for user's shoulder, because the protection fiber 31*a* is coated integrally with the protrusions 3 and because space between the protrusions can be ventilated.

In order to connect to the bag the shoulder strap 9 having the shock absorber 10 according to the present invention, the shoulder strap 9 is connected to the bag in a direction in which the absorbing portion 1 is brought into contact with one's shoulder, as shown in FIGS. 1 and 2. In such a manner, the plurality of protrusions 3, which are filled with air, function as an air cushion, thereby absorbing the load applied on the shoulder. Also, the shock caused while carrying the bag or item is absorbed by the extensibility and resilience of the reinforcement portion 2 made of a resilient material, thereby alleviating the impact force of the load and softening the pain on the shoulder. Therefore, the user can be free of fatigue and feel comfortable when carrying the bag or item on the shoulder. Further, a finger-pressure treatment effect can be attained by the plurality of protrusions 3, thereby facilitating blood circulation of the user. Moreover, the separate protrusions of the absorbing portion can provide the user with a non-slip shoulder strap.

Figure 6:
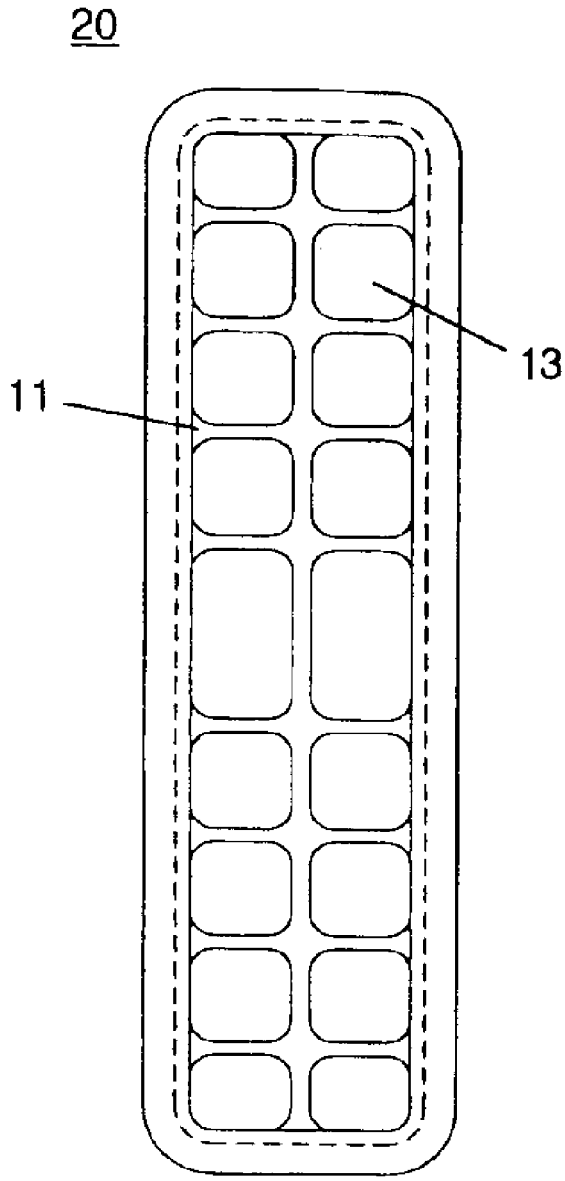
FIG. 6 is a plan view of a shock absorber for a shoulder strap according to another embodiment of the present invention.
Figure 7:
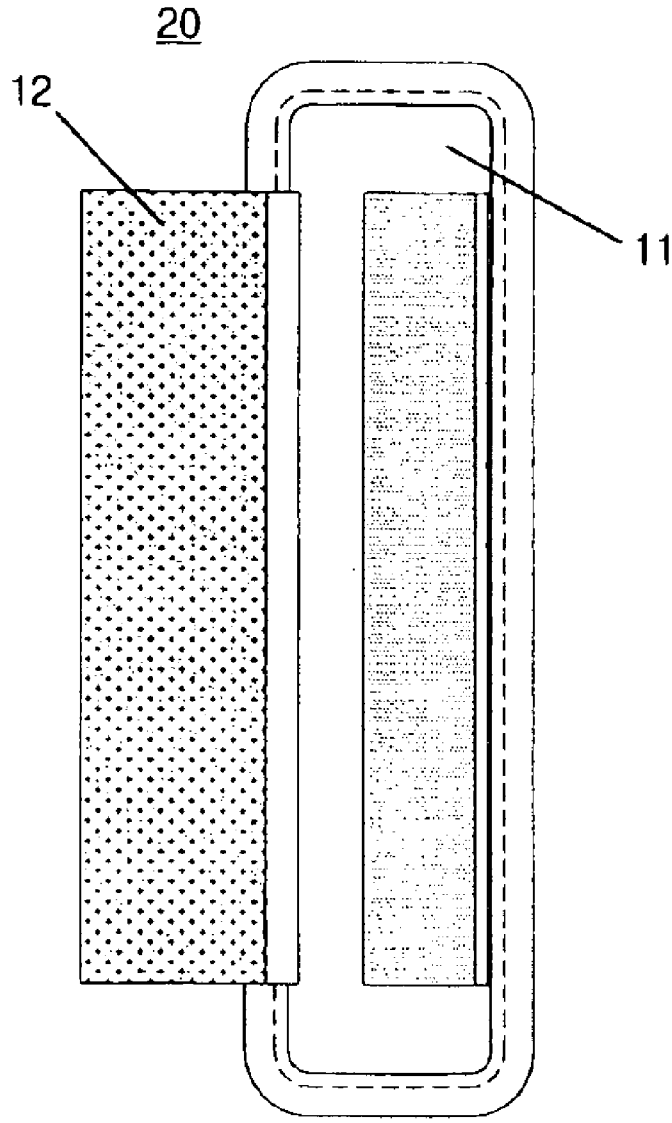
FIG. 7 is a rear view of the shock absorber for a shoulder strap shown in FIG. 6.

FIG. 6 is a plan view of a shock absorber for a shoulder strap according to another embodiment of the present invention, and FIG. 7 is a rear view of the shock absorber for a shoulder strap shown in FIG. 6. Referring to FIGS. 6 and 7, a shock absorber 20 according to this embodiment includes a panel-like absorbing portion 11 having a plurality of protrusions 13 filled with air, and hermetically and separately sealed, and a connecting portion 12 which is formed of an adhesive cloth, for example, hook and loop material, is sewed together with the absorbing portion 11 and detachably wraps a predetermined portion of the shoulder strap 9.

The absorbing portion 11 is the same as the absorbing portion 1, which has been described, in the above embodiment in view of functions and effects, and a detailed explanation thereof will not be made. The upper and lower portions of the absorbing portion 11 are integrally coated with natural or synthetic protection fibers for protecting the surfaces of the absorbing portion 11 as in FIG. 5.

According to this embodiment, an extendable reinforcement portion may not be provided. However, in a preferred embodiment, the reinforcement portion may be separately connected to the shoulder strap having a predetermined width at its arbitrary position.

Therefore, the shock absorber 20 can be attached to a conventional shoulder strap connected to the bag or carried item itself. The absorbing portion 11 is positioned in a direction in which the absorbing portion 11 is brought into contact with one's shoulder, and then a shoulder strap(not shown) is wrapped by the connecting portion 12 and the absorbing portion 11. Next, the adhesive cloth pieces made of hook and loop material of the connecting portion 12 are adhered to each other for attachment to an arbitrary portion of the shoulder strap.

In such a manner, the plurality of protrusions 3, which are filled with air, function as an air cushion against TPU resin, which is highly resilient, thereby absorbing the load applied on the shoulder. Accordingly, the weight of the load due to the bag or carried item itself is alleviated, thereby softening the pain on the shoulder.

What is claimed is:

1. A shock absorber for a shoulder strap comprising:

a panel-like absorbing portion having a plurality of protrusions filled with air and hermetically and separately sealed, the absorbing portion comprising a flat lower potion, an upper portion forming the protrusions and attached to the lower portion, a protection fiber attached outward to the lower portion and a protection fiber integrally attached outward to the upper portion and having a shape conforming to the shape of the protrusions such that the protrusions are restrained from deforming wherein the plurality of protrusions of the absorbing portion are formed separately by compression-molding thermal polyurethane resin and are arranged in a lattice pattern; and a reinforcement portion sewed together with the absorbing portion on one of its sides and connected to the middle of the shoulder strap and has a predetermined width with opposite end portions, wherein the reinforcement portion is made of resilient and extensible material, and is of a length larger than that of the absorbing portion so that the opposite end portions of the reinforcement portion can be extended permitting the reinforcement portion to absorb shock acting on the users shoulder.

* * * * *